United States Patent [19]

Badesha et al.

[11] Patent Number: 4,855,201

[45] Date of Patent: Aug. 8, 1989

[54] PHOTOCONDUCTIVE IMAGING MEMBERS WITH ELECTRON TRANSPORTING POLYSILYLENES

[75] Inventors: Santokh S. Badesha, Pittsford; Steven J. Grammatica, Penfield; Frank Jansen, Webster, all of N.Y.

[73] Assignee: Xerox Corporation, Stamford, Conn.

[21] Appl. No.: 189,496

[22] Filed: May 2, 1988

[51] Int. Cl.[4] ..... G03G 5/08; G03G 5/10

[52] U.S. Cl. ..... 430/58; 430/63

[58] Field of Search ..... 430/58, 63

[56] References Cited

U.S. PATENT DOCUMENTS 4,518,670 5/1985 Matsuzaki et al. ..... 430/58
4,544,729 10/1985 Nate et al. ..... 528/28
4,587,205 5/1986 Harrah et al. ..... 430/326
4,618,551 10/1986 Stolka et al. ..... 430/58
4,758,488 7/1988 Johnson et al. ..... 430/58 X
4,772,525 9/1988 Badesha et al. ..... 430/58
4,774,159 0/1988 Stolka et al. ..... 430/58

*Primary Examiner*—Paul R. Michl
*Assistant Examiner*—Jeffrey A. Lindeman
*Attorney, Agent, or Firm*—E. O. Palazzo

[57] ABSTRACT

A negatively charged photoconductive imaging member comprised of a supporting substrate; an electron polysilylene transporting layer; a metal oxide layer; and thereover a photogenerating layer comprised of hydrogenated amorphous silicon.

28 Claims, 1 Drawing Sheet

PHOTOCONDUCTIVE IMAGING MEMBERS WITH ELECTRON TRANSPORTING POLYSILYLENES

BACKGROUND OF THE INVENTION

This invention is directed generally to photoconductive imaging members with electron transporting polysilylenes. More specifically, in one embodiment the present invention is directed to negatively charged imaging members comprised of a photogenerating layer of hydrogenated, or halogenated amorphous silicon, an electron transport layer comprised of the polysilylenes as illustrated in U.S. Pat. No. 4,618,551, the disclosure of which is totally incorporated herein by reference, and situated therebetween a metal oxide layer. The aforementioned members in one particular aspect of the present invention are comprised of a supporting substrate, a hydrogenated amorphous silicon photogenerating layer, an electron transport layer comprised of a polysilylene, especially poly(methylphenyl) silylene, poly(n-propylmethyl) silylene, and other similar silylenes; and situated between the electron transport and photogenerating layers a metal oxide layer comprised of silicon oxides. The photoconductive imaging members of the present invention are particularly useful in electrophotographic, and especially xerographic imaging processes including those wherein there are selected for development liquid ink compositions. Further, the imaging members of the present invention possess chemical and electrical stability, and can be utilized for extended time periods in electrophotographic imaging apparatuses.

Imaging members comprised of polysilylenes are illustrated in U.S. Pat. No. 4,618,551, the disclosure of which is totally incorporated herein by reference. More specifically, there is illustrated in this patent a polysilylene hole transporting compound for use in layered imaging members comprised of the formula as recited in claim 1. More specifically, there is described in the aforementioned patent an improved layered photoresponsive imaging member comprised of a supporting substrate, a photogenerating layer, and as a hole transport layer in contact therewith, a polysilylene compound of the formula

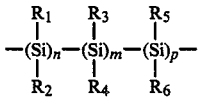

wherein $R_1$, $R_2$, $R_3$, $R_4$, $R_5$, and $R_6$ are independently selected from the group consisting of alkyl, substituted alkyl, substituted aryl, and alkoxy; and m, n, and p are numbers that reflect the percentage of the particular monomer unit in the total polymer compound. Preferred polysilylene hole transporting compounds illustrated in this patent include poly(methylphenyl silylenes), which silylenes preferably have a weight average molecular weight of in excess of 50,000, and preferably are of a weight average molecular weight of about 75,000 to about 1,000,000. The aforementioned polysilylenes can be prepared by known methods, reference the *Journal of Organometallic Chemistry,* page 198, C27 (1980), R. E. Trujillo, the disclosure of which is totally incorporated herein by reference. Also, other polysilylenes can be prepared as described in the *Journal of Polymer Science,* Polymer Chemistry Edition, Vol. 22, pages 225 to 238, (1984), John Wiley and Sons, Inc., the disclosure of which is totally incorporated herein by reference. More specifically, the aforementioned polysilylenes can be prepared as disclosed in the aforesaid article by the condensation of a dichloromethylphenyl silane with an alkali metal such as sodium. In one preparation sequence, there is reacted a dichloromethyl phenyl silane in an amount of from about 0.1 mole with sodium metal in the presence of 200 milliliters of solvent, which reaction is accomplished at a temperature of from about 100° C. to about 140° C. There results, as identified by elemental analysis, infrared spectroscopy, UV spectroscopy, and nuclear magnetic resonance, the polysilylene products subsequent to the separation thereof from the reaction mixture.

In column 8, lines 57 to 68, of the U.S. Pat. No. 4,618,551 patent there is disclosed the selection of a photogenerator of hydrogenated amorphous silicon for incorporation into a photoconductive imaging member containing the aforementioned polysilylenes as a hole transport layer.

Other patents primarily of background interest are U.S. Pat. Nos. 4,518,670; 4,544,729; and 4,587,205; and U.K. No. 2,021,545.

SUMMARY OF THE INVENTION

It is an object of the present invention to provide photoconductive imaging members with the advantages indicated herein.

It is another object of the present invention to provide polysilylenes as electron transporting substances in layered photoresponsive imaging members.

Moreover, in a further object of the present invention there are provided negatively charged photoconductive imaging members comprised of electron transporting polysilylene, and hydrogenated amorphous silicon; and wherein the polysilylenes are free of degradation upon exposure to light, and do not emit undesirable byproducts subsequent to being subjected to corona charging processes in electrophotographic imaging apparatuses.

Another object of the present invention resides in the provision of photoconductive imaging members with electron transporting polysilylenes with metal oxides in contact therewith.

In addition, another object of the present invention resides in photoconductive imaging members with electron transporting polysilylenes and thereover protective overcoatings.

Another object of the present invention resides in imaging members with electron transporting polysilylenes with improved electrical stability, acceptable residual charge, and surface potentials; and wherein the transport properties thereof are substantially enhanced.

Furthermore, another object of the present invention resides in the provision of layered imaging members that are negatively charged thus enabling images formed thereon to be developed with conventional known developer compositions, and wherein the quality of the resulting images possess excellent resolution, for example, with no background deposits.

These and other objects of the present invention are accomplished by the provision of photoconductive imaging members with electron transporting polysilylenes. More specifically, there are provided in accordance with the present invention negatively charged photoconductive imaging members comprised of hydrogenated or halogenated amorphous silicon photogenerating layers, electron transporting polysilylenes of the formula

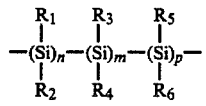

wherein $R_1$, $R_2$, $R_3$, $R_4$, $R_5$, and $R_6$ are independently selected from the group consisting of alkyl, aryl, substituted alkyl, substituted aryl, and alkoxy; and m, n, and p are numbers that reflect the percentage of the particular monomer unit in the total polymer composition with the sum of n plus m plus p being equal to 100 percent, and situated therebetween metal oxides, such as silicon oxide. Specifically, in the aforementioned formula zero percent is less than, or equal to n, and n is less than or equal to 100 percent; and zero percent is less than, or equal to m, and m is less than, or equal to 100 percent; and zero is less than, or equal to p, and p is less than, or equal to 100 percent. Any of the monomer units of the polysilylene can be randomly distributed throughout the polymer, or may alternatively be in blocks of varying lengths.

Illustrative specific examples of polysilylene electron transporting compounds that may be selected for the photoconductive imaging members of the present invention include poly(methylphenyl silylene), poly(methylphenyl silylene-co-dimethyl silylene), poly(cyclohexylmethyl silylene), poly(tertiary-butylmethyl silylene), poly(phenylethyl silylene), poly(n-propylmethyl silylene), poly(ptolylmethyl silylene), poly(cycletrimethylene silylene), poly(cyclotetramethylene silylene), poly(cyclopentamethylene silylene), poly(di-t-butyl silylene-co-di-methyl silylene), poly(diphenyl silylene-cophenylmethly silylene), poly(cyanoethylmethyl silylene), poly(phenylmethyl silylene), and the like. Preferred electron transport polysilylenes selected for the imaging members of the present invention include poly(methylphenyl) silylene, poly(cyclohexylmethyl) silylene, and poly(phenethylmethyl) silylene. This layer is preferably of a thickness of from about 4 to about 25 microns. Although it is not desired to be limited by theory, it is believed that the polysilylenes are functioning as electron transports since the charge generated in the amorphous silicon layer is injected into the polysilylene through the oxide layer. Accordingly, the polysilylene is acting as an electron transport media.

With further aspect to the imaging member of the present invention, the charge photogenerating layer consists preferably of hydrogenated amorphous silicon or doped hydrogenated amorphous silicon wherein the dopants include halogen materials. In a further embodiment, this layer is protected and electrically pacified with a thin layer thereover of, silicon nitride, silicon carbide, or hydrogenated amorphous carbon. In addition, the thickness of this layer is preferably from about 0.5 micron to about 3 microns, and preferably 1.5 microns. The aforementioned protective layer is usually not selected when the polysilylene charge transport layer is situated between the supporting substrate and the photogenerating layer.

Examples of metal oxide layers, usually present in a thickness of from about 0.1 micron to about 5 microns, include silicon oxides, tin oxides, germanium oxides, and the like. Layers with other thicknesses can be selected providing the objectives of the present invention are achieved.

The photoconductive imaging members of the present invention can be prepared by a number of known methods, the process parameters, and the order of the coating of the layers being dependent on the member desired. Thus, for example, the members of the present invention can be prepared by providing a conductive substrate with an optional hole blocking layer, and optional adhesive layer; and applying thereto by solvent coating processes, laminating processes, or other methods, the electron transporting polysilylene layer, the metal oxide layer, and the photogenerating layer. Other methods include melt extrusion, dip coating, and spraying.

In one specific embodiment, a supporting substrate such as aluminum is provided. Thereafter, there is applied the electron transport polysilylene layer from a solution thereof, which application can be accomplished by a number of known methods, such as draw bar coating, dip coating, and the like. Generally, the aforementioned solution contains from about 1 to about 10 weight percent of polysilylene polymer in a solvent such as benzene, toluene, and the like. Subsequent to drying, wherein the solvent is eliminated, the resulting device is placed in a plasma reactor (PECVD - Plasma Enhanced Chemical Vapor Deposition) for the purpose of adding the metal oxide layer. In these processes, silane gas, either pure or admixed with oxygen, nitrogen, or carbon containing gases and optionally doped, are decomposed in an electrical discharge into condensable radicals which bond to the growing film. Temperatures of deposition are between about 200 to about 250° C., however, other temperatures outside these ranges may be selected provided the objectives of the present invention are achievable. Dopants include phosphorus or diboron in amounts of from about 1 to about 20 parts per million, and preferably 10 parts per million. Thereafter, the optional overcoating can be also applied by PECVD wherein, for example, a mixture of ammonia gas and silane is selected for the silicon nitride overcoating.

BRIEF DESCRIPTION OF THE DRAWINGS

For a better understanding of the present invention and further features thereof, reference is made to the following detailed description of various embodiments wherein.

As overcoatings for these members, there can be selected silicon nitrides, amorphous carbon, silicon carbides, and the like, which overcoatings are applied in thicknesses of from about 0.1 to about 5 microns. These overcoatings are applied by known plasma enhanced chemical vapor deposition processes.

DESCRIPTION OF THE PREFERRED EMBODIMENTS

Figure 1:
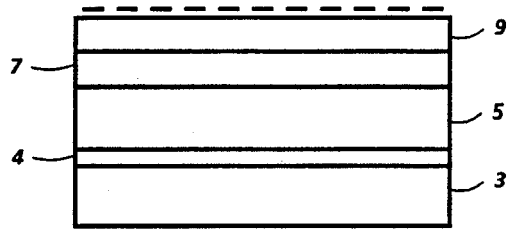
FIG. 1 is a partially schematic cross-sectional view of a photoconductive imaging member of the present invention.

Illustrated in FIG. 1 is a negatively charged photoresponsive imaging member of the present invention comprising a supporting substrate 3, an optional adhesive blocking layer 4, a polysilylene electron transporting layer 5, a silicon oxide layer 7, and a charge carrier photogenerating layer 9 comprised of a hydrogenated, amorphous silicon component with from about 10 to about 30 atomic percent of hydrogen.

Figure 2:
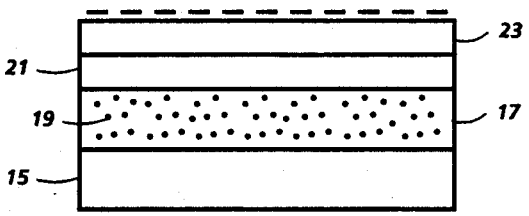
FIG. 2 represents a partially schematic cross-sectional view of a photoconductive imaging member of the present invention.

Illustrated in FIG. 2 is a negatively charged photoconductive imaging member of the present invention comprised of a conductive supporting substrate 15 of aluminized Mylar, an electron transport layer 17 comprised of a poly(methylphenyl silylene) 19 with a preferred thickness of about 10 microns, a silicon dioxide layer 21 with a preferred thickness of 0.1 micron, and a photogenerating layer 23 with a preferred thickness of 0.5 micron comprised of hydrogenated amorphous silicon with about 20 atomic percent of hydrogen. The photogenerating and electron transporting components may be dispersed in inactive resinous binders such as polyesters, polycarbonates, and the like.

Other imaging members similar to those as presented in FIGS. 1 and 2 are included within the scope of the present invention such as those wherein, for example, protective overcoating layers like silicon carbide, and silicon nitride can be utilized with preferred thicknesses of from about 1 to about 2 microns.

With further respect to the imaging members of the present invention, the supporting substrate layers may be opaque or substantially transparent, and may comprise any suitable material having the requisite mechanical properties. Thus, these substrates may comprise a layer of nonconducting material such as an inorganic or organic polymeric material, a layer of an organic or inorganic material having a conductive surface layer arranged thereon or a conductive material such as, for example, aluminum, chromium, nickel, indium, tin oxide, brass or the like. The substrate may be flexible or rigid and may have any of many different configurations such as, for example, a plate, a cylindrical drum, a scroll, an endless flexible belt, and the like. Preferably, the substrate is in the form of an endless flexible belt. The thickness of the substrate layer depends on many factors including economical considerations. Thus, this layer may be of substantial thickness, for example, over 100 mils or minimum thickness providing there are no adverse effects on the imaging member. In one preferred embodiment, the thickness of this layer ranges from about 3 mils to about 10 mils.

Examples of photogenerating components are hydrogenated, or halogenated amorphous silicon with from about 10 to about 30, and preferably from about 25 to about 40 atomic percent of hydrogen, or halogen. Generally, it is desirable to provide this layer in a thickness which is sufficient to absorb about 90 percent or more of the incident radiation, which is directed upon it in the imagewise exposure step. The maximum thickness of this layer is dependent primarily upon facts such as mechanical considerations, for example, whether a flexible photoresponsive imaging member is desired. However, generally this layer is of a thickness of from about 1 to about 25 microns, and preferably from about 4 to about 25 microns.

Optional resin binders selected for the polysilylene layer include, for example, the polymers as illustrated in U.S. Pat. No. 3,121,006, the disclosure of which is totally incorporated herein by reference; polyesters, polyvinyl butyrals, polyvinyl carbazoles, polycarbonate resins, epoxy resins, polyhydroxyether resins, and the like.

Also, there can be included in the imaging members illustrated herein adhesive layers such as polyester resins available as Ditel PH-100, Ditel PH-200, and Ditel PH-222, all available from Goodyear Tire and Rubber Company; polyvinyl butyral; DuPont 49,000 polyester; and the like. The aforementioned adhesive layer is generally of a thickness of from about 200 micrometers to about 900 micrometers, and is applied from a solvent solution of, for example, tetrahydrofuran, toluene and methylene chloride. This adhesive layer can be situated on the supporting substrate or may be situated between an optional hole blocking layer and the supporting substrate. Examples of blocking layers include siloxanes as illustrated in U.S. Pat. No. 4,464,450, the disclosure of which is totally incorporated herein by reference. Other blocking layers include the silylenes as illustrated in U.S. Pat. Nos. 4,338,387; 4,286,033; and 4,291,110, the disclosures of which are totally incorporated herein by reference, including (gamma-amino propyl)methyl diethoxy silylenes.

The imaging members of the present invention are useful in various electrophotographic imaging systems, especially xerographic systems, wherein an electrostatic image is formed on the photoresponsive imaging member, followed by the development thereof with a toner composition comprised of resin particles and pigment particles, reference for example U.S. Pat. Nos. 4,558,108; 4,298,672; and 4,569,635, the disclosures of each of these patents being totally incorporated herein by reference; thereafter transferring the developed image to a suitable substrate, and fixing of the resultant image.

More specifically, the surface of the photoreceptor described above is uniformly charged to the desired polarity using a corotron charging device common to the practice of electrophotography. Thereafter, the charged photoreceptor is exposed in imagewise manner to light of a wavelength almost entirely absorbed by the charge generating layer. Charge carriers generated in this layer are separated by the electric field in such a way that positive carriers migrate to the negatively charged surface while negative charge carriers, electrons, migrate to the positive or ground electrode (substrate). In this manner, a latent electrostatic image is created which will in subsequent steps become developed and transferred to a substrate material like paper. Subsequently, transferred image may then be fixed to the substrate using heat or pressure, or a combination thereof.

In the aforementioned layered photoreceptor, it is important that electrons be injected into the transport layer with high efficiency and be transported through the layer without loss due to trapping, which will result in the buildup of residual charge. Residual charge will cause the resultant image to be of poor quality. It is also important that the transport of electrons through the transport layer be rapid with respect to subsequent processes occuring in a copying machine. For example, after exposure the charge transport must be substantially completed before the latent image is subjected to the development process which renders the latent electrostatic image visible. If transport is still occuring at the time of development, a poor image will be obtained. With the imaging members of the present invention, the aforesaid problems are substantially alleviated.

The polysilylene electron transporting polymers illustrated herein possess several advantages when selected for a photoreceptor device. Thus, for example, these polymers can be effective with photogenerating materials that have a high efficiency for the generation of electrons. Electron transport will allow increased freedom of design with respect to surface charging and development. For example, if one desires to utilize a negative toner, and positive surface charging, device could be fabricated with a photogenerating layer on the substrate overcoated with an electron transporting layer. Electrons generated in the charge generating layer and transported through the charge transport layer would neutralize the positive surface charge in an imagewise manner to create the latent electrostatic image. This latent image could then be developed with the desirable negative toner.

The invention will now be described in detail with respect to specific preferred embodiments thereof, it being understood that these examples are intended to be illustrative only. The invention is not intended to be limited to the materials, conditions, and process parameters recited. All parts and percentages are by weight unless otherwise indicated.

EXAMPLE I

There was prepared a photoresponsive imaging member by coating on an aluminum substrate, which has a thickness of about 3 mils, by the known draw bar coating process, poly(methylphenyl) silylene, weight average molecular weight 900,000, from a 2 percent solution in toluene. After drying, this layer had a thickness of about 10 microns. Subsequently, there was added to the silylene layer by draw bar coating silicon oxide in a thickness of 0.1 micron, followed by a layer of hydrogenated amorphous silicon in a thickness of 0.5 micron with 20 atomic percent of hydrogen. Subsequently, there was applied an overcoating layer of silicon nitride (SiNx) in a thickness of 2 microns.

EXAMPLE II

A photoresponsive imaging member was prepared by repeating the procedure of Example I with the exception that there was selected poly(cyclohexylmethyl) silylene with a weight average molecular weight of 750,000 in place of the poly(methylphenyl)silylene, which layer was coated from a 30 percent solution in toluene.

EXAMPLE III

A photoresponsive imaging member was prepared by repeating the process of Example I with the exception that there was selected poly(phenethylmethyl) silylene with a weight average molecular weight of 800,000 in place of the poly(methylphenyl) silylene, and coating was accomplished from a 40 percent solution in toluene. Further, the thicknesses of the layers were 8 microns for the poly(phenethylmethyl) silylene; 0.1 micron for the silicon oxide; 0.5 micron for the hydrogenated amorphous silicon; and 1.5 microns for the silicon nitride.

Photodischarge curves for the imaging member of Example I indicate excellent contrast potential. Accordingly, images of high quality would be generated in a xerographic imaging test fixture with the negatively charged imaging member of Example I incorporated therein, and subsequent to formation and development of the image on the imaging member with a known toner composition comprised of resin particles and pigment particles; and more specifically, 88 percent by weight of a styrene n-butyl methacrylate resin, 10 percent by weight of carbon black particles, and 2 percent by weight of the charge enhancing additive cetyl pyridinium chloride. It is believed that substantially similar results can be obtained with the imaging members of Examples II and III.

EXAMPLE IV

There was prepared a photoresponsive imaging member by providing an aluminized Mylar substrate in a thickness of 3 mils, followed by applying thereto with a multiple clearance film applicator in a wet thickness of 0.5 mil, a layer of '3-aminopropyl triethyloxy silane, available from PCR Research Chemicals of Florida, in ethanol in about 1 to 5 ratio. After drying for 5 minutes at room temperature, followed by curing for 10 minutes at 100° C. in a forced air oven, there was applied as an electron transporting layer poly(methylphenyl silylene) from a solution of toluene and tetrahydrofuran, volume ratio of 2:1, this deposition being affected by spraying. After drying, this layer had a thickness of about 10 microns. Subsequently, there was applied to the polysilylene layer utilizing a Bird applicator a photogenerating layer of hydrogenated amorphous silicon with 20 atomic percent of hydrogen, which layer was of a thickness of 0.4 micron.

Thereafter, this imaging member is incorporated into a xerographic imaging test fixture, and images with excellent resolution and substantially no background deposits will result for periods exceeding 50,000 imaging cycles.

Although the invention has been described with reference to specific preferred embodiments, it is not intended to be limited thereto. Those skilled in the art, subsequent to a review of the present application, will recognize that variations, and modifications thereof can be accomplished which are within the spirit of the invention and within the scope of the following claims.

What is claimed is:

1. A negatively charged photoconductive imaging member comprised of a supporting substrate; an electron polysilylene transporting layer; a metal oxide layer; and thereover a photogenerating layer comprised of hydrogenated amorphous silicon.

2. An imaging member in accordance with claim 1 wherein the polysilylene is of the formula

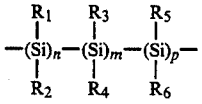

wherein $R_1$, $R_2$, $R_3$, $R_4$, $R_5$, and $R_6$ are independently selected from the group consisting of alkyl, aryl, substituted alkyl, substituted aryl, and alkoxy; and m, n, and p are numbers that represent the percentage of the monomer unit in the total polymer.

3. An imaging member in accordance with claim 2 wherein the polysilylene is poly(methylphenyl) silylene, poly(cyclohexyl methyl) silylene, poly(phenethyl methyl) silylene, poly(n-propylmethyl silylene)-comethylphenyl silylene, or poly(n-propylmethyl silylene).

4. An imaging member in accordance with claim 2 wherein the polysilylene is of a weight average molecular weight of from about 400,000 to about 1,000,000.

5. An imaging member in accordance with claim 2 wherein the supporting substrate is polymer, or a conductive material.

6. An imaging member in accordance with claim 5 wherein the supporting substrate is aluminized Mylar.

7. An imaging member in accordance with claim 2 wherein the metal oxide is silicon oxide, or tin oxide.

8. An imaging member in accordance with claim 1 wherein the amorphous silicon contains from about 25 to about 40 atomic percent of hydrogen.

9. An imaging member in accordance with claim 2 wherein the amorphous silicon contains from about 25 to about 40 atomic percent of hydrogen.

10. An imaging member in accordance with claim 9 wherein the amorphous silicon is doped with phosphorus, or boron.

11. An imaging member in accordance with claim 1 wherein the electron transporting layer is dispersed in an inactive resinous binder.

12. An imaging member in accordance with claim 11 wherein the binder is a polyester, a polycarbonate, or polyvinylcarbazole stabilizer.

13. An imaging member in accordance with claim 1 wherein the polysilylene layer is a thickness of from about 4 to about 25 microns, and the hydrogenated amorphous silicon layer is from about 3 to about 10 microns in thickness.

14. An imaging member in accordance with claim 1 wherein the imaging member contains thereover a protective layer.

15. An imaging member in accordance with claim 14 wherein the protective overcoating is comprised of amorphous carbon, silicon nitrides, or silicon carbides.

16. An imaging member in accordance with claim 2 containing thereover a protective overcoating of amorphous carbon, silicon nitrides, or silicon carbides.

17. An imaging member in accordance with claim 16 wherein a supporting substrate is comprised of a conductive material, or a polymeric composition.

18. An imaging member in accordance with claim 2 wherein the supporting substrate is of a thickness of from about 3 mils to about 10 mils; the photogenerating layer is a thickness of from about 0.3 micron to about 10 microns; and the polysilylene electron transport layer is a thickness of from about 2 microns to about 25 microns.

19. A process for generating developed electrostatic latent images which comprises providing the imaging member of claim 1; forming thereon a negative electrostatic latent image; thereafter accomplishing the development of this image; subsequently transferring the developed image to a suitable substrate; and affixing the image thereto.

20. A process in accordance with claim 19 wherein the imaging member retains its electrical characteristics for 1,000,000 imaging cycles.

21. A negatively charged photoconductive imaging member comprised of an electron polysilylene transporting layer; a metal oxide layer; and thereover a photogenerating layer comprised of hydrogenated amorphous silicon.

22. An imaging member in accordance with claim 1 wherein the polysilylene electron transporting layer is situated between the supporting substrate and the metal oxide layer.

23. A negatively charged photoconductive imaging member which comprises, in the order stated, a supporting substrate; an electron transporting polysilylene layer; a metal oxide layer; and a photogenerating layer comprising hydrogenated amorphous silicon.

24. An imaging member in accordance with claim 23 wherein the polysilylene is of the formula

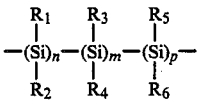

wherein $R_1$, $R_2$, $R_3$, $R_4$, $R_5$, and $R_6$ are independently selected from the group consisting of alkyl, aryl, substituted alkyl, substituted aryl, and alkoxy; and m, n, and p are numbers that represent the percentage of the monomer unit in the total polymer.

25. An imaging member in accordance with claim 23 wherein the polysilylene is selected from the group consisting of poly(methylphenyl) silylene, poly(cyclohexyl methyl) silylene, poly(phenethyl methyl) silylene, poly(n-propylmethyl silylene)-comethylphenyl silylene, and poly(n-propylmethyl silylene).

26. An imaging member in accordance with claim 23 wherein the polysilylene is of a weight average molecular weight of from about 400,000 to about 1,000,000.

27. A process for generating developed electrostatic latent images which comprises providing the imaging member of claim 23, forming thereon a negative electrostatic latent image, thereafter developing the image, subsequently transferring the developed image to a suitable substrate, and affixing the image thereto.

28. A process in accordance with claim 27 wherein the imaging member retains its electrical characteristics for 1,000,000 imaging cycles.

* * * * *